US011145993B2

(12) United States Patent
Yang et al.

(10) Patent No.: US 11,145,993 B2
(45) Date of Patent: Oct. 12, 2021

(54) ANTENNA MODULE AND TERMINAL THEREOF

(71) Applicants: Electric Connector Technology Co., Ltd., Shenzhen (CN); Shanghai University, Shanghai (CN)

(72) Inventors: Guangli Yang, Shenzhen (CN); Yuanqing Chen, Shanghai (CN); Yong Luo, Shanghai (CN); Jiayou Xu, Shanghai (CN); Zefeng Jiang, Shanghai (CN); Xiang Zhang, Shenzhen (CN); Yingjie Zhang, Shenzhen (CN); Eugene Yu-Jiun Ren, Shenzhen (CN)

(73) Assignees: ELECTRIC CONNECTOR TECHNOLOGY CO., LTD., Guangming Newdistrict (CN); SHANGHAI UNIVERSITY, Shanghai (CN)

( * ) Notice: Subject to any disclaimer, the term of this patent is extended or adjusted under 35 U.S.C. 154(b) by 0 days.

(21) Appl. No.: 16/832,723

(22) Filed: Mar. 27, 2020

(65) Prior Publication Data

US 2020/0313305 A1 Oct. 1, 2020

(30) Foreign Application Priority Data

Mar. 28, 2019 (CN) ..... 201910242556.4

(51) Int. Cl.
*H01Q 21/06* (2006.01)
*H01Q 1/48* (2006.01)
*H01Q 21/00* (2006.01)

(52) U.S. Cl.
CPC ..... *H01Q 21/065* (2013.01); *H01Q 1/48* (2013.01); *H01Q 21/0025* (2013.01)

(58) Field of Classification Search
CPC ..... H01Q 21/0006; H01Q 21/0025; H01Q 21/065; H01Q 1/38; H01Q 5/10
See application file for complete search history.

(56) References Cited

U.S. PATENT DOCUMENTS

| | | | | |
|---|---|---|---|---|
| 2015/0070228 | A1* | 3/2015 | Gu | H01Q 1/2283 343/727 |
| 2018/0219587 | A1* | 8/2018 | Huo | H04B 1/40 |
| 2019/0103665 | A1* | 4/2019 | Yoo | H01Q 1/523 |
| 2020/0021010 | A1* | 1/2020 | Ou | H01Q 1/243 |
| 2020/0021011 | A1* | 1/2020 | Cooper | H01Q 1/243 |
| 2020/0280131 | A1* | 9/2020 | Avser | H01Q 5/307 |

* cited by examiner

*Primary Examiner* — Jason Crawford

(57) ABSTRACT

An antenna module and a terminal applying the antenna module are disclosed. The antenna module includes an antenna array configured with a plurality of antenna units and a radio-frequency phase shifting system. The antenna array and the radio-frequency phase shifting system are integrated on a circuit substrate to form an independent module. Further, the antenna unit of the antenna module may adopt a solution of a microstrip patch antenna structure loading a short-circuit pillar to generate multiple resonances, thereby expanding the bandwidth of the antenna unit. After the antenna array is formed, the antenna modules may be further arranged perpendicular to each other to expand and achieve large-angle scanning and polarization diversity functions. The disclosed antenna module has a simplified structure and may be applied to 5G communication. It has the advantages of easy system integration, low-profile miniaturization, wide radiation bandwidth, and large-angle scanning.

19 Claims, 5 Drawing Sheets

ANTENNA MODULE AND TERMINAL THEREOF

CROSS-REFERENCE TO RELATED APPLICATIONS

The present application claims the priority of the Chinese Patent Application No. 201910242556.4, filed on Mar. 28, 2019 and titled ANTENNA MODULE AND TERMINAL THEREOF, and the content of which is incorporated by reference herein in its entirety, the specification of which is incorporated by reference herein in its entirety.

TECHNICAL FIELD

The disclosure relates to the field of communication technology, and in particular, to an antenna module and terminal thereof.

BACKGROUND

With the development of wireless communication technology, terminal devices such as mobile phones, tablet computers, portable multimedia players, etc., become essential necessities of life. An antenna module is usually configured inside the terminal device to transmit and receive wireless signals to support the wireless communication function of the terminal device.

Today, the fifth generation mobile communication technology (5G) is the focus of current research and development, and the development of 5G has become an industry consensus. Due to the unique high carrier frequency and large bandwidth properties, millimeter wave is the main means to achieve 5G ultra-high-speed data transmission rates. At present, most of 5G millimeter-wave antenna modules for terminal use antenna on board (AOB) solution, that is, an antenna array is arranged on a side of the terminal, and a radio-frequency circuit part (such as a radio-frequency phase shifting system) is integrated on a main board, so that the array and the radio-frequency circuit are arranged separately, which cannot be integrated into a module that works independently. In other existing technical solutions, although the beam bandwidth of the antenna is increased, and a large-angle scanning of the antenna array may be implemented, due to complicated multi-resonant structures and low dielectric constant materials, a profile of the antenna is high and it is difficult to implement an integrated application.

Therefore, it is necessary to provide a new antenna module to solve the above problems.

SUMMARY

An object of the present disclosure is to provide an antenna module that solves above-mentioned problems, and another object of the present disclosure is to provide a terminal using the above-mentioned antenna module.

The technical solution adopted by the present disclosure is to provide an antenna module including an antenna array which is configured with a plurality of antenna units and a radio-frequency phase shifting system. The antenna array and the radio-frequency phase shifting system are integrated on a circuit substrate to form an independent module.

In a preferred embodiment thereof, the antenna array is a millimeter-wave antenna array in which antenna units are arranged in a 4×2 Multiple Input Multiple Output (MIMO) arrangement and combination.

In a preferred embodiment thereof, the antenna unit includes a dielectric base layer, a radiation patch, a short-circuit pillar, a signal connecting pillar, and a ground layer; the radiation patch is arranged on a face of the dielectric base layer, and the ground layer is arranged on the opposite face of the dielectric base layer, the short-circuit pillar penetrates the dielectric base layer to electrically connect the radiation patch and the ground layer together, and the signal connecting pillar is used to provide an input and output feed point for external signal.

In a preferred embodiment thereof, a plurality of short-circuit pillars may be provided to form a plurality of corresponding resonances with the radiation patch to expand bandwidth of the antenna unit.

In a preferred embodiment thereof, the bandwidth of the antenna array covers at least a range of 24.75 GHz to 27.5 GHz.

In a preferred embodiment thereof, the radiation patch is rectangular. A low frequency radiation part is tuned by the long side of the rectangular radiation patch, and a high frequency radiation part is tuned by the short side of the rectangular radiation patch.

In a preferred embodiment thereof, the horizontal distance between the antenna units is 4 mm, and the longitudinal distance is 5 mm. A transverse beam scanning angle of the antenna array can reach a coverage of +/−60°.

In a preferred embodiment thereof, the radio-frequency phase shifting system includes a millimeter-wave transceiver chip and a related circuit, the millimeter-wave transceiver chip and the related circuit are located on a face of the circuit substrate, and the antenna units of the antenna array are located on the opposite face of the circuit substrate.

In a preferred embodiment thereof, the circuit substrate is a multi-layer circuit substrate, which successively includes a radiation patch layer, a first reference ground layer, a signal layer, a power layer, and a second reference ground layer, with each of the layers being stacked and spaced by dielectric substrates; the radiation patch layer and the first reference ground layer are electrically connected through a vertically extending antenna short-circuit pillar, with a feeder line as an input and output feed point, so as to form an antenna unit; a signal pin of the millimeter-wave transceiver chip is electrically connected to the feeder line by a chip signal connecting pillar via the signal layer, and a power pin of the millimeter-wave transceiver chip is electrically connected to the power layer by a power connecting pillar.

In a preferred embodiment thereof, a first ground short-circuit pillar is provided on both sides of the chip signal connecting pillar, and the first ground short-circuit pillar connects the ground potential around the chip signal connecting pillar as a whole to provide a full ground reference for the chip signal connecting pillar.

In a preferred embodiment thereof, it further includes a third reference ground layer and at least one second ground short-circuit pillar. The third reference ground layer is located between the power layer and the second reference ground layer, and the second ground short-circuit pillar is connected to the ground potential of each respective layer to improve electromagnetic compatibility of the antenna module.

In a preferred embodiment thereof, it further includes a connection base and a radio-frequency interface. The millimeter-wave transceiver chip has integrated transmitting and receiving function and may be in any one of two states of receiving or transmitting beam scanning. The state of the millimeter-wave transceiver chip is determined by a control signal externally connected to the connection base, and the millimeter-wave transceiver chip may implement external interactive communication through the radio-frequency interface.

In a preferred embodiment thereof, the related circuit includes a power synthesizing circuit, and a plurality of millimeter-wave transceiver chips are provided. The signals received from the antenna array are processed by the plurality of millimeter-wave transceiver chips, and then are synthesized into one signal by the power synthesizing circuit and may be provided to external processing through the radio-frequency interface.

In a preferred embodiment thereof, a plurality of connection bases are arranged in a center axisymmetry manner on a face of the side of the circuit substrate where the millimeter-wave transceiver chip is located, the connection bases may be used for controlling a signal interface and may also be used for providing a power interface.

In a preferred embodiment thereof, the power synthesizing circuit is located on a center axis, and the plurality of millimeter-wave transceiver chips are symmetrically arranged on both sides of the power synthesizing circuit. The radio-frequency interface is located on a side of the power synthesizing circuit on the center axis, and the connection base in a middle position is located on another side of the power synthesizing circuit on the center axis.

In a preferred embodiment thereof, the antenna unit may be fed in a coaxial manner, that is, the feeder line is a feeder signal pillar formed by extending vertically from the radiation patch layer.

In a preferred embodiment thereof, the antenna unit may be fed in a coupling manner, that is, the feeder line is a microstrip feeder line with the first reference ground layer as a reference ground, and the first reference ground layer is provided with a coupling opening which intersects with the microstrip feeder line.

The present disclosure also provides a terminal including any one of the antenna modules described above.

In a preferred embodiment thereof, the antenna modules are arranged separately at a predetermined distance, and two antenna modules in adjacent areas are arranged perpendicularly to each other in a radiation direction.

Compared with the existing related art, an antenna module provided by the present disclosure adopts a multilayer circuit structure, and integrates an antenna array and a radio-frequency phase shifting system on one circuit substrate to form an independent module, which is convenient for system-level integration and large-scale application. In addition, in preferred solutions thereof, an antenna unit of an antenna module of the present disclosure adopts a solution of a microstrip patch antenna structure loading a short-circuit pillar, which generates multiple resonances, thereby expanding the bandwidth of the antenna unit, simplifying the structure and achieving low-profile miniaturization. After the antenna array is formed, the antenna modules may be further arranged by arranging the antenna modules perpendicular to each other to expand and achieve large-angle scanning and polarization diversity functions.

REFERENCE NUMBER

Figure 1:
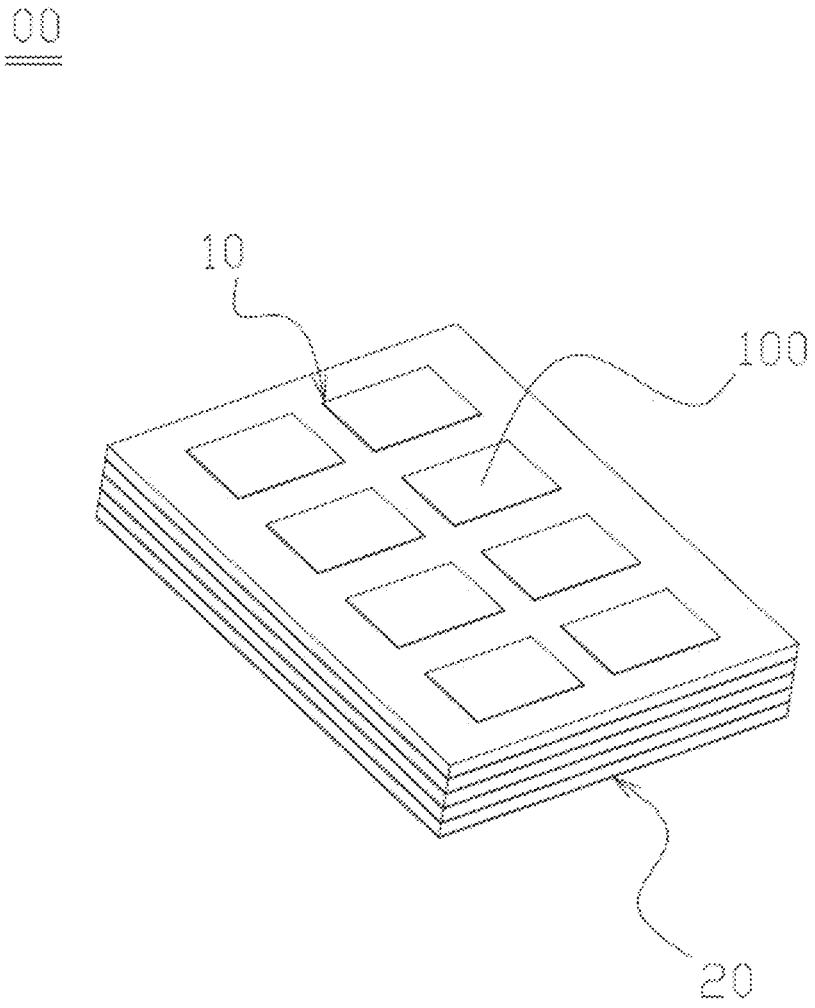
FIG. 1 is a schematic structural diagram of an antenna module according to a preferred embodiment of the present disclosure.

Antenna module 00 Antenna array 10 Radio-frequency phase shifting system 20 Antenna unit 100 (100') Radiation patch 101, 101', 101" Dielectric base layer 102 Short-circuit pillar 103, 103' Signal connecting pillar 104, 104" Ground layer 105 First dielectric base layer 102' Microstrip feeder line 104' First reference ground layer 105' Second dielectric base layer 106' Coupling opening 107' Millimeter-wave transceiver chip 201 Related circuit 202 Power synthesizing circuit 202*a* Connection base 30, 301, 302, 303 Radio-frequency interface 40 Signal layer 108 Power layer 109 Second reference ground layer 110 Third reference ground layer 111 Antenna short-circuit pillar 103" Signal pin 201*a* Power pin 201*b* Chip signal connecting pillar 1041 Power connecting pillar 1042 First ground short-circuit pillar 1031 Second ground short-circuit pillar 1032 Communication terminal 01 Battery 011

DETAILED DESCRIPTION

Reference will be made to the accompanying drawings and embodiments to describe the present disclosure in detail, so that the objects, technical solutions and advantages of the present disclosure may be more apparent and understandable. It should be understood that the specific embodiments described herein are only used to explain the present disclosure and not intended to limit the present disclosure.

The technical solution provided by the embodiments of the present disclosure relates to an antenna module, which may be applied to a terminal having a communication function, such as a mobile phone, a tablet computer, a notebook, a smart watch, a dual-screen tablet computer, and the like. The embodiments of the present disclosure do not limit this. In order to adapt to the trend of miniaturization and integration, an antenna module of the embodiment of the present disclosure mainly integrates a core antenna array and a radio-frequency phase shifting system on a circuit substrate to form an independent module, which may be flexibly applied to various circuits, and may support 5G millimeter-wave beam scanning, but not limited to this.

Please refer to FIG. 1, which shows a schematic structural diagram of an antenna module 00 according to a preferred embodiment of the present disclosure.

As shown in FIG. 1, the antenna module 00 adopts a 4×2 millimeter-wave antenna array arranged in a 4×2 MIMO arrangement and combination, and includes an antenna array 10 which is configured with eight antenna units 100 and a radio-frequency phase shifting system 20. The antenna array 10 and the radio-frequency phase shifting system 20 are integrated on a circuit substrate to form an independent module. In other embodiments, the number and form of the antenna units may be different, for example, a 4×1 array is used (now accordingly, the number of millimeter-wave transceiver chips is only one), which is not limited.

Figure 2A:
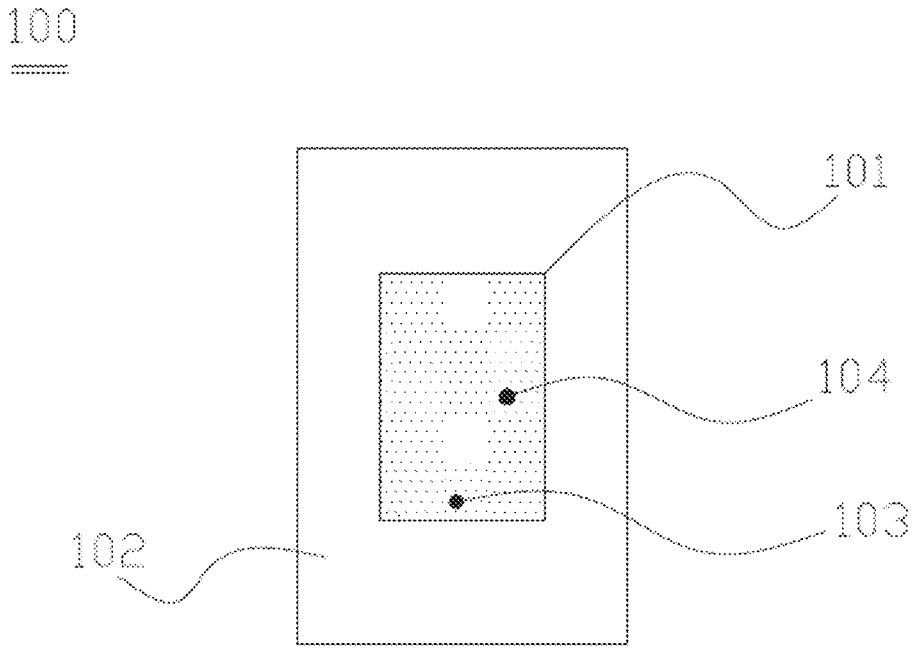
FIG. 2A is a front schematic diagram of an enlarged antenna unit in FIG. 1.
Figure 2B:
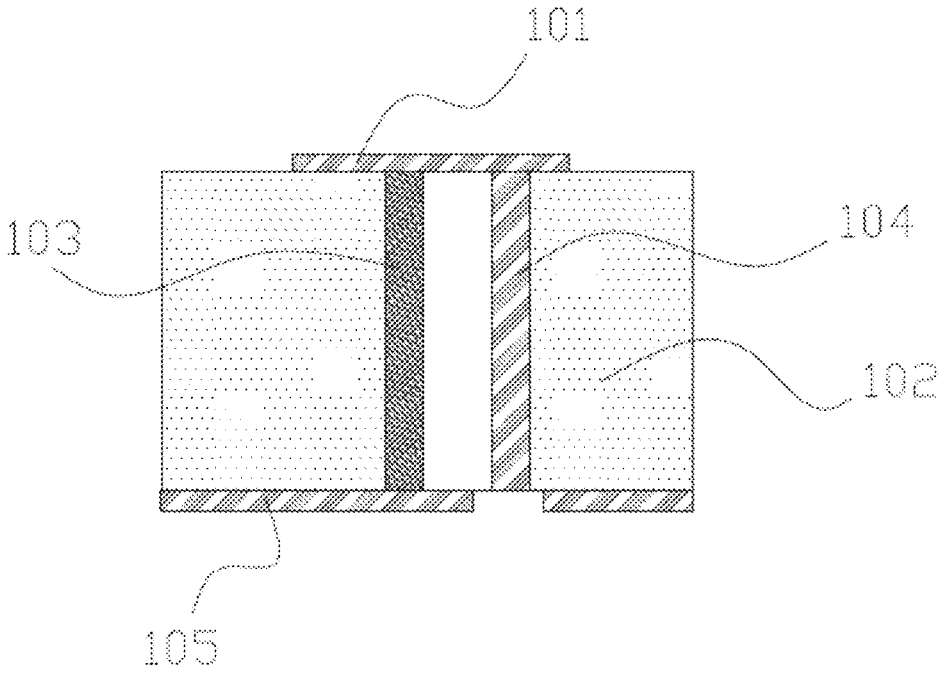
FIG. 2B is a cross-sectional schematic structural diagram of the antenna unit in FIG. 2A.
Figure 2C:
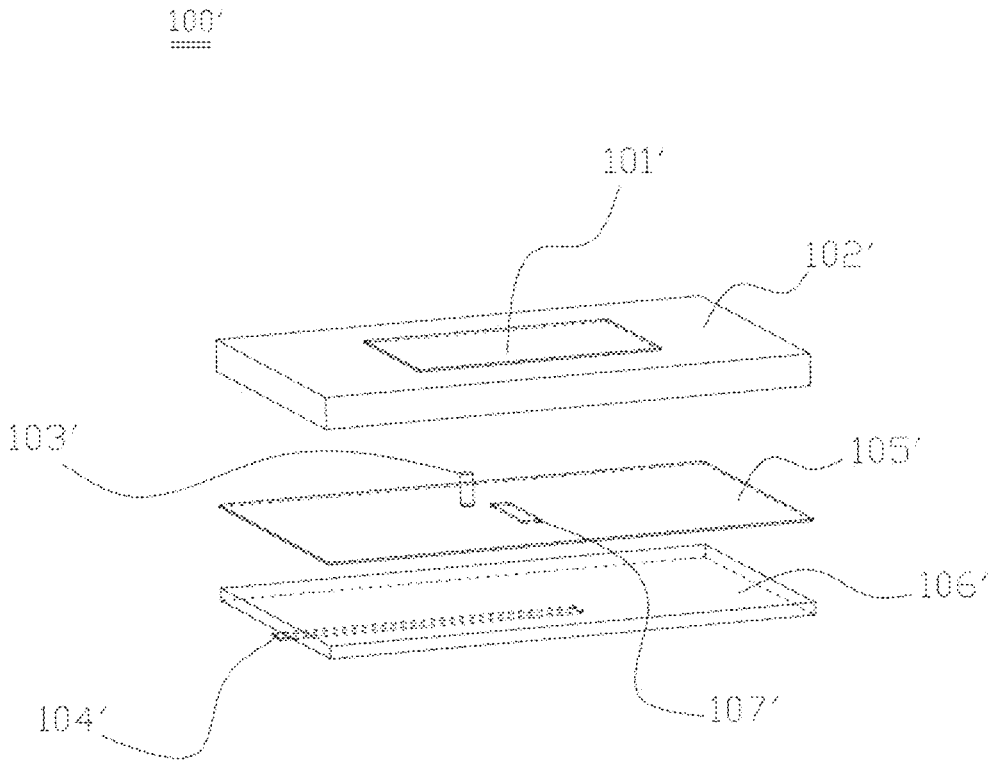
FIG. 2C is a schematic structural diagram of an antenna unit in FIG. 1 adopting a coupling feeding manner.

Referring to FIG. 2A, FIG. 2B, and FIG. 2C, the design idea of the antenna unit 100 is to innovate the traditional microstrip patch antenna structure and increase the resonance by loading a short-circuit pillar structure so as to improve the radiation bandwidth. Specifically, in this embodiment, the antenna unit 100 is mainly composed of a two-layer circuit board and is fed by a coaxial feeding mode, which includes a radiation patch 101, a dielectric base layer 102, a short-circuit pillar 103, a signal connecting pillar 104 and a ground layer 105. The dielectric base layer 102 is made of an insulating material, usually a material with a low dielectric constant, so as to be suitable for high-frequency applications. The radiation patch 101 is a rectangular conductive metal sheet (usually a copper foil), which is arranged on one face of the dielectric base layer 102, and the ground layer 105 is also a conductive metal sheet (usually a copper foil), which is arranged on the opposite face of the dielectric base layer 102, so as to form a microstrip structure antenna. A low frequency radiation part may be tuned by the long side of the radiation patch 101, and a high frequency radiation part may be tuned by its short side, so as to cover a certain bandwidth. The short-circuit pillar 103 is a conductor, and may be a cylindrical metallized via hole which penetrates the dielectric base layer 102 and electrically connects the radiation patch 101 and the ground layer 105 together. The signal connecting pillar 104 is a conductor formed by vertically extending from the radiation patch layer 101, and may also be a cylindrical metallized via hole which is a necessary feeder line for a coaxial feeding mode to provide an input and output feed point for an external signal.

In the present disclosure, one short-circuit pillar 103 may generate a resonance peak correspondingly, and together with the resonance peak generated by the radiation patch 101 of the microstrip structure, the bandwidth that the antenna may radiate is expanded. In actual application, it is found through measurement that the bandwidth of the antenna array thus formed may be expanded to cover at least a bandwidth of more than 2G, and the preferred frequency range is 24.75 GHz to 27.5 GHz. Certainly, according to design requirements, a plurality of the short-circuit pillars 103 may be provided at different positions, so that a plurality of different resonance peaks are generated, thereby achieving a wider bandwidth required.

In other embodiments, the antenna unit 100' shown in FIG. 2C includes a radiation patch 101', a first dielectric base layer 102', a short-circuit pillar 103', a microstrip feeder line 104', a first reference ground layer 105' and a second dielectric base layer 106', and is fed in a coupling manner. That is, a microstrip feeder line 104' using the first reference ground layer 105' (equivalent to the ground layer 105 mentioned above) as a reference ground is used as a feeder line to provide an input and output feed point for an external signal. The first reference ground layer 105' is provided with a coupling opening 107' that intersects the microstrip feeder line 104', thereby achieving the same effect as the coaxial feeding mode.

Figure 3:
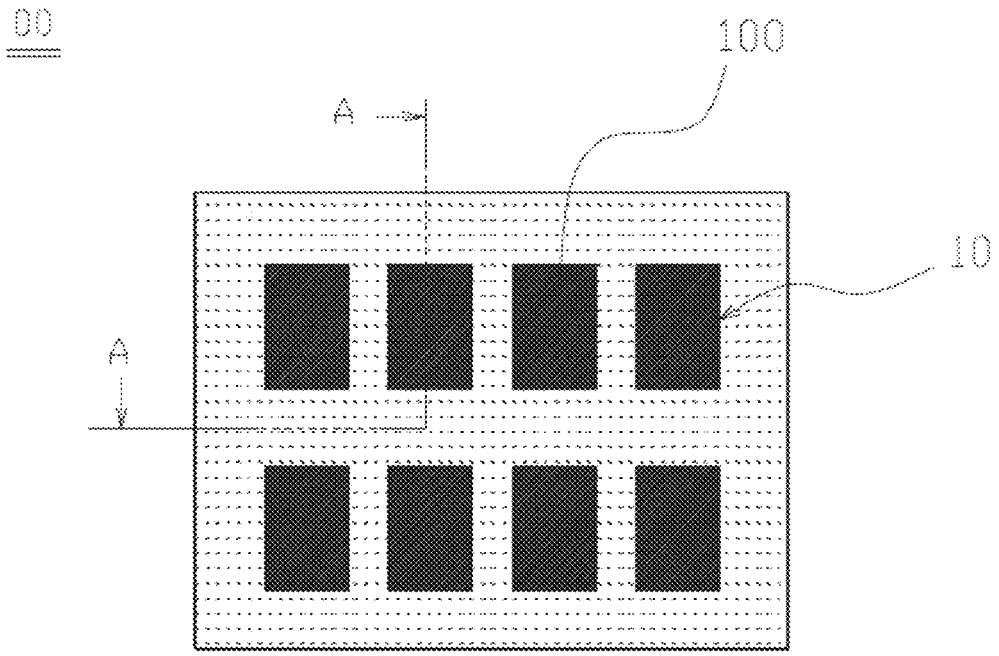
FIG. 3 is a front view of FIG. 1.
Figure 4:
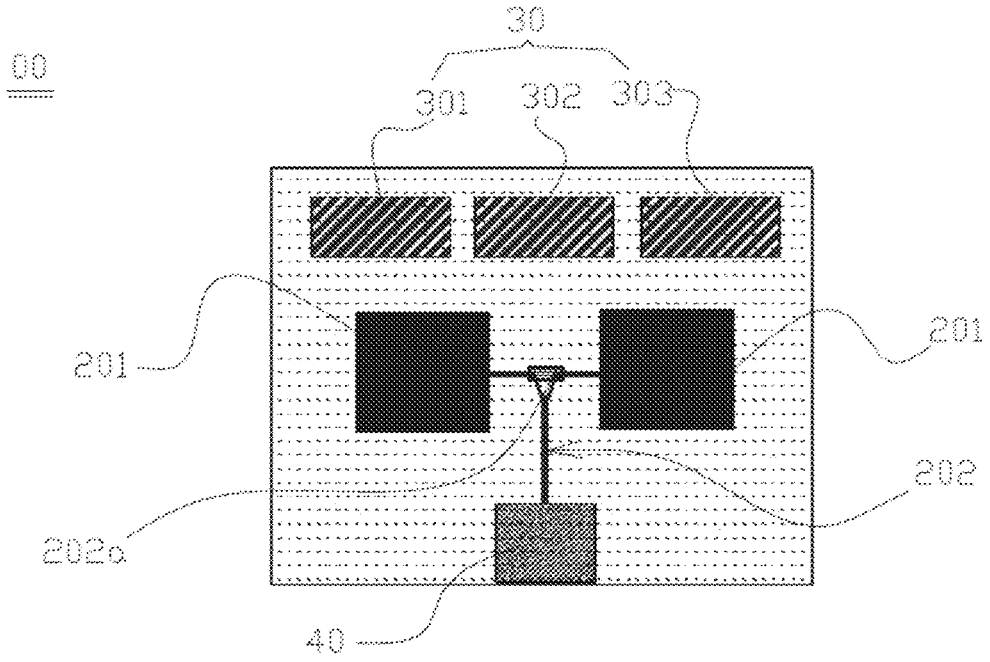
FIG. 4 is a bottom view of FIG. 1.
Figure 5:
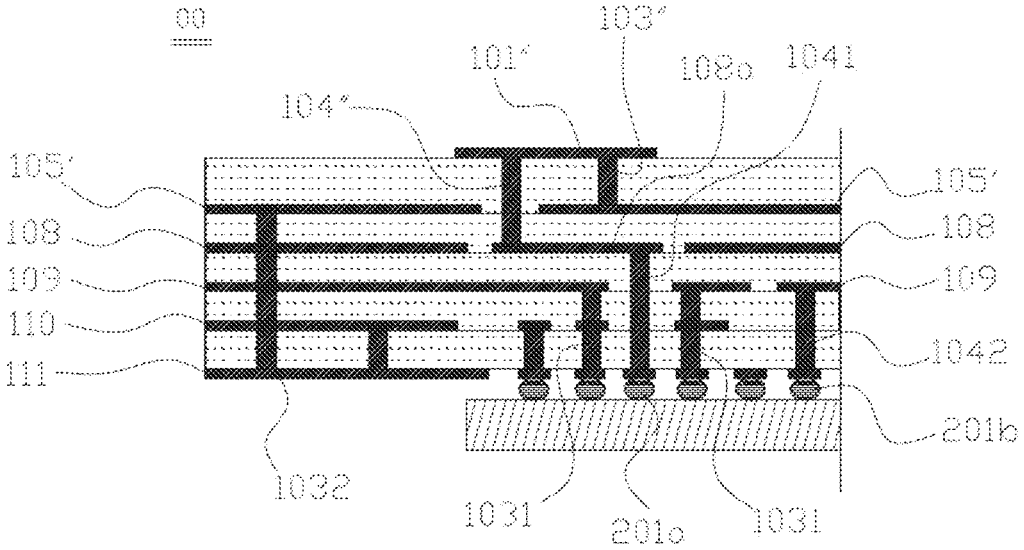
FIG. 5 is a cross-sectional schematic structural diagram taken along a line A-A in FIG. 3.

Further, as shown in FIGS. 3 to 5 and in combination with FIG. 1, an antenna module 00 integrated by a multilayer circuit substrate is shown as an integrated independent module. An antenna array 10 configured with the antenna units 100 in a 4×2 array is arranged on one face (defined as a front face) of the circuit substrate. A radio-frequency phase shifting system 20, a connection base 30 and a radio-frequency interface 40 are arranged on the opposite face (defined as a bottom face) of the circuit substrate. In this embodiment, a horizontal distance between the antenna units 100 in array is 4 mm and a longitudinal distance is 5 mm by optimization design. The experimental results show that the antenna radiation performance at this time reaches the optimal state. The radio-frequency phase shifting system 20 includes two millimeter-wave transceiver chips 201 and a related circuit 202. The two millimeter-wave transceiver chips 201 are exactly the same, both having integrated transmitting and receiving function, and may be in any one of two states of receiving and transmitting beam scanning, which are determined by the Serial Peripheral Interface (SPI) control signal externally connected to the connection base 30. The millimeter-wave transceiver chip 201 has four channels to match the arrangement of a 4×2 antenna array. The related circuit 202 includes at least a power synthesizing circuit 202*a* for synthesizing signals of the two millimeter-wave transceiver chips 201 into one signal.

As shown in FIG. 4, the connection bases 30 are usually board-to-board connectors with multiple transmission channels. There are three connection bases 30 arranged in one row on the bottom surface in a center axisymmetry manner for providing power support for the millimeter-wave transceiver chips 201 and a communication interface for external signals of status control. The connection base 302 in the middle position provides a power interface (channel), and the remaining two connection bases 301 and 303 may be used for both the control signals interface (channel) and the power interface (channel).

The radio-frequency interface 40 is generally a coaxial socket connected to an external cable connector, and the millimeter-wave transceiver chip 201 may implement external interactive communication through the radio-frequency interface 40.

Referring again to FIG. 4, in order to simplify the circuit and its layout and obtain the best performance effect, the power synthesizing circuit 202*a* is provided on the center axis of the antenna module 00. The two millimeter-wave transceiver chips 201 are arranged symmetrically on both sides of the power synthesizing circuit 202*a*. The radio-frequency interface 40 is arranged on one side of the power synthesizing circuit 202*a*, and the connection base 302 in the middle position is provided on the other side of the power synthesizing circuit 202*a*. The other two connection bases 301 and 303 are symmetrically arranged on both sides of the connection base 302. With the above arrangement, signals received from the antenna array 10 are processed by the two millimeter-wave transceiver chips 201, and are synthesized into one signal by the power synthesizing circuit 202*a*. Then the signal is provided to external processing through the radio-frequency interface 40. The corresponding connecting lines associated with this process may be minimized, and the routing layout is the most reasonable, so as to obtain the optimal target.

Further, referring to FIG. 5, an embodiment in which one antenna unit adopts a coaxial feeding mode is shown. The circuit substrate of the antenna module 00 is a multilayer circuit substrate formed by lamination process. The circuit substrate includes from top to bottom a radiation patch layer 101", a first reference ground layer 105', a signal layer 108, a power layer 109, a second reference ground layer 110, and a third reference ground layer 111, and the above-mentioned layers are stacked and spaced by dielectric substrates. The antenna unit 100 of the aforementioned antenna array is configured with the radiation patch layer 101", the first reference ground layer 105', an antenna short-circuit pillar 103" vertically electrically connecting them and a signal connecting pillar 104" vertically extending from the radiation patch layer 101" and being used as a feeder line. The millimeter-wave transceiver chip 201 is provided with a signal pin 201*a* and a power pin 201*b*. The signal pin 201*a* is electrically connected to the signal connecting pillar 104" according to a coaxial feeding mode via the signal layer 108 (specifically, a signal path 108*a*) by a chip signal connecting pillar 1041 vertically extending from the signal pin 201*a*, so as to be connected to the radiation patch layer 101". In other embodiments, the millimeter-wave transceiver chip 201 may also be connected to the radiation patch layer 101" by the aforementioned coupling feeding manner to achieve a similar effect; the power pin 201*b* is electrically connected to the power layer 109 by the power connecting pillar 1042 so as to provide power supply transmission path.

It can be known from the above that eight antenna units 100 arranged in a 4×2 manner in the antenna array are located on the upper part of the circuit substrate, the radio-frequency phase shifting system 20 is located on the lower part of the circuit substrate, and a plurality of interfaces is provided in a bottom surface of the antenna module, including an SPI signal and power interface and a radio-frequency interface 40 provided in the connection base 30. The radio-frequency phase shifting system 20 may interact with and control external signals by the connection base 30 to implement management and control for the millimeter-wave transceiver chip 201. The millimeter-wave transceiver chip 201 is connected to the radio-frequency interface 40 through a power synthesizing circuit 202*a*, and the radio-frequency interface 40 may be connected to a bottom board (not shown in the figure) of a terminal to provide one signal synthesized by the power synthesizing circuit 202*a* to a terminal main chip (not shown in the figure) for processing.

Further, in order to reduce transmission loss, a first ground short-circuit pillar 1031 may be provided on both sides of the chip signal connecting pillar 1041, and the first ground short-circuit pillar 1031 connects the ground potential around the chip signal connecting pillar 1041 as a whole, thereby providing a full ground reference for the chip signal pillar 1041. Furthermore, a third reference ground layer 111 is provided, and at least one second ground short-circuit pillar 1032 is provided, so that the ground potential of each corresponding layer is connected by the second ground short-circuit pillar 1032 to improve the electromagnetic compatibility of the antenna module 00. Certainly, in other designs that are not sensitive to electromagnetic compatibility, the third reference ground layer 111 and the second ground short-circuit pillar 1032 may not be added.

Figure 6:
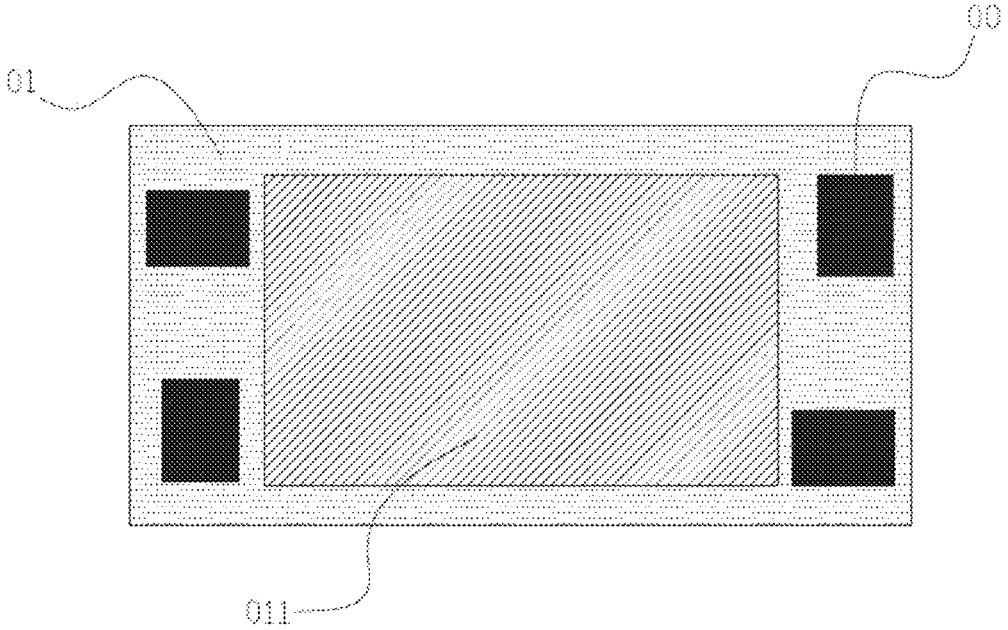
FIG. 6 is a schematic structural diagram of a reduced scale of an antenna module in FIG. 1 applied to a terminal.

As shown in FIG. 6, an embodiment in which an antenna module 00 is applied to the communication terminal 01 is provided. In this embodiment, a battery 011 located in the middle and four antenna modules 00 arranged on the top and bottom ends of the communication terminal 01 around the battery 011 are included. The antenna modules 00 are arranged in a 4×4 MIMO layout and adopt a polarization diversity scheme, that is, perpendicularly arranged on the same side. Because one antenna module 00 can only perform beam scanning in one direction, two antenna modules 00 arranged perpendicular to each other may achieve beam scanning in two directions mutually perpendicular, which increases the beam coverage of the antenna module MIMO. Moreover, the polarization directions of the antenna arrays of the two antenna modules are also perpendicular to each other, which enables the millimeter-wave MIMO array to receive electromagnetic waves of two polarization directions, enhancing the signal receiving capability of the smart phone terminal. Through experimental measurement, the transverse beam scanning angle of this antenna array may cover at least +/−60°, achieving the effect of large-angle scanning.

In conclusion, the antenna module provided by the present disclosure adopts an independent module for the first time and may be flexibly applied to various applications. The antenna unit of its antenna module expands the bandwidth of the antenna array by adding short-circuit pillars, and through reasonable arrangement, it may achieve large-angle scanning and polarization diversity functions. Its structure is simplified and it conforms to the trend of low-profile miniaturization and has a very broad market space in 5G communication.

The technical features of the above embodiments may be arbitrarily combined. For the sake of brevity of description, not all possible combinations of the technical features in the above embodiments are described. However, as long as there is no contradiction between the combinations of these technical features, all should be considered as the scope of this specification.

The above-mentioned embodiments merely represent several embodiments of the present disclosure, and the description thereof is more specific and detailed, but it should not be construed as limiting the scope of the present disclosure. It should be noted that, several modifications and improvements may be made for those of ordinary skill in the art, without departing from the concept of the present disclosure, and these are all within the protection scope of the present disclosure. Therefore, the protection scope of the present disclosure shall be subject to the appended claims.

What is claimed is:

1. An antenna module, comprising:

an antenna array configured with a plurality of antenna units and a radio-frequency phase shifting system, wherein the antenna array and the radio-frequency phase shifting system are integrated on a circuit substrate to form an independent module;

wherein:

the antenna unit comprises a dielectric base layer, a radiation patch, a short-circuit pillar, a signal connecting pillar, and a ground layer;

the radiation patch is arranged on a face of the dielectric base layer;

the ground layer is arranged on an opposite face of the dielectric base layer;

the short-circuit pillar penetrates the dielectric base layer to electrically connect the radiation patch and the ground layer together; and the signal connecting pillar is configured to provide an input and output feed point for external signal.

2. The antenna module according to claim 1, wherein the antenna array is a millimeter-wave antenna array in which antenna units are arranged in a 4×2 MIMO arrangement and combination.

3. The antenna module according to claim 2, wherein:

a horizontal distance between the antenna units is 4 mm, and a longitudinal distance is 5 mm;

a transverse beam scanning angle of the antenna array can reach a coverage of +/−60°.

4. The antenna module according to claim 1, wherein a plurality of short-circuit pillars are provided to form a plurality of corresponding resonances with the radiation patches to expand bandwidth of the antenna unit.

5. The antenna module according to claim 4, wherein the bandwidth of the antenna array covers at least a range of 24.75 GHz to 27.5 GHz.

6. The antenna module according to claim 1, wherein:

the radiation patch is rectangular; and a low frequency radiation part is tuned by a long side of the rectangular radiation patch, and a high frequency radiation part is tuned by a short side of the rectangular radiation patch.

7. The antenna module according to claim 1, wherein:

the radio-frequency phase shifting system comprises a millimeter-wave transceiver chip and a related circuit;

the millimeter-wave transceiver chip and the related circuit are located on a face of the circuit substrate; and the antenna unit of the antenna array is located on an opposite face of the circuit substrate.

8. The antenna module according to claim 7, wherein:

the circuit substrate is a multilayer circuit substrate successively including a radiation patch layer, a first reference ground layer, a signal layer, a power layer, and a second reference ground layer, with each of the layers being stacked and spaced by dielectric substrates;

the radiation patch layer and the first reference ground layer are electrically connected by a vertically extending antenna short-circuit pillar, with a feeder line as an input and output feed point, so as to form an antenna unit;

a signal pin of the millimeter-wave transceiver chip is electrically connected to the feeder line by a chip signal connecting pillar via the signal layer; and a power pin of the millimeter-wave transceiver chip is electrically connected to the power layer by a power connecting pillar.

9. The antenna module according to claim 8, wherein:

a first ground short-circuit pillar is provided on both sides of the chip signal connecting pillar, and the first ground short-circuit pillar connects the ground potential around the chip signal connecting pillar as a whole to provide a full ground reference for the chip signal connecting pillar.

10. The antenna module according to claim 8, further comprising a third reference ground layer and at least one second ground short-circuit pillar, wherein:

the third reference ground layer is located between the power layer and the second reference ground layer, and the second ground short-circuit pillar is connected to the ground potential of each respective layer to improve electromagnetic compatibility of the antenna module.

11. The antenna module according to claim 8, further comprising a connection base and a radio-frequency interface, wherein:

the millimeter-wave transceiver chip has an integrated transmitting and receiving function and is in any one of two states of receiving or transmitting beam scanning;

the state of the millimeter-wave transceiver chip is determined by a control signal externally connected to the connection base; and the millimeter-wave transceiver chip implements external interactive communication through the radio-frequency interface.

12. The antenna module according to claim 11, wherein:

the related circuit comprises a power synthesizing circuit, and a plurality of millimeter-wave transceiver chips are provided;

the signals received from the antenna array are processed by the plurality of millimeter-wave transceiver chips, and then are synthesized into one signal by the power synthesizing circuit, and are provided to external processing through the radio-frequency interface.

13. The antenna module according to claim 12, wherein a plurality of connection bases are arranged in a center axisymmetry manner on a face of the side of the circuit substrate where the millimeter-wave transceiver chip is located, the connection bases are configured to control a signal interface and provide a power interface.

14. The antenna module according to claim 12, wherein:

the power synthesizing circuit is located on a center axis;

the plurality of millimeter-wave transceiver chips are symmetrically arranged on both sides of the power synthesizing circuit;

the radio-frequency interface is located on a side of the power synthesizing circuit on the center axis; and the connection bases in a middle position is located on another side of the power synthesizing circuit on the center axis.

15. The antenna module according to claim 8, wherein the antenna unit is fed in a coaxial manner, with the feeder line being a feeder signal pillar formed by extending vertically from the radiation patch layer.

16. The antenna module according to claim 8, wherein:

the antenna unit is fed in a coupling manner, the feeder line being a microstrip feeder line with the first reference ground layer as a reference ground; and the first reference ground layer is provided with a coupling opening which intersects with the microstrip feeder line.

17. A terminal, comprising the antenna module according to claim 1.

18. The terminal according to claim 17, wherein the antenna modules are arranged separately at a predetermined distance, and two antenna modules in adjacent areas are arranged perpendicularly to each other in a radiation direction.

19. An antenna module, comprising:

an antenna array configured with a plurality of antenna units and a radio-frequency phase shifting system, wherein the antenna array and the radio-frequency phase shifting system are integrated on a circuit substrate to form an independent module;

wherein:

the radio-frequency phase shifting system comprises a millimeter-wave transceiver chip and a related circuit;

the millimeter-wave transceiver chip and the related circuit are located on a face of the circuit substrate;

the antenna unit of the antenna array is located on an opposite face of the circuit substrate the circuit substrate is a multilayer circuit substrate successively including a radiation patch layer, a first reference ground layer, a signal layer, a power layer, and a second reference ground layer, with each of the layers being stacked and spaced by dielectric substrates;

the radiation patch layer and the first reference ground layer are electrically connected by a vertically extending antenna short-circuit pillar, with a feeder line as an input and output feed point, so as to form an antenna unit;

a signal pin of the millimeter-wave transceiver chip is electrically connected to the feeder line by a chip signal connecting pillar via the signal layer; and a power pin of the millimeter-wave transceiver chip is electrically connected to the power layer by a power connecting pillar.

* * * * *